US008302732B2

(12) United States Patent
Gorke et al.

(10) Patent No.: US 8,302,732 B2
(45) Date of Patent: Nov. 6, 2012

(54) SILENCER

(75) Inventors: Peter Gorke, Stuttgart (DE); Michael Pommerer, Uhingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 13/028,561

(22) Filed: Feb. 16, 2011

(65) Prior Publication Data

US 2011/0198150 A1 Aug. 18, 2011

(30) Foreign Application Priority Data

Feb. 18, 2010 (DE) ..... 10 2010 008 403

(51) Int. Cl.
*F01N 1/08* (2006.01)

(52) U.S. Cl. ..... 181/265; 181/212; 181/228

(58) Field of Classification Search ..... 181/212, 181/228, 265
See application file for complete search history.

(56) References Cited

U.S. PATENT DOCUMENTS

| | | | | |
|---|---|---|---|---|
| 4,645,521 | A * | 2/1987 | Freesh | 55/309 |
| 5,677,518 | A | 10/1997 | Fischer et al. | |
| 5,952,625 | A * | 9/1999 | Huff | 181/265 |
| 6,595,319 | B1 * | 7/2003 | Huff | 181/250 |
| 7,503,427 | B2 * | 3/2009 | Toyoshima | 181/272 |
| 7,506,723 | B2 * | 3/2009 | Hoerr et al. | 181/250 |
| 7,798,286 | B2 * | 9/2010 | Skowronski et al. | 181/266 |
| 2005/0210865 | A1 | 9/2005 | Bolander et al. | |

FOREIGN PATENT DOCUMENTS

| | | | |
|---|---|---|---|
| AT | 54 721 | E | 4/1987 |
| BE | 513 629 | A | 9/1952 |
| DE | 16 95 647 | U | 3/1955 |
| DE | 39 488 | A1 | 9/1965 |
| EP | 0 243 559 | A1 | 11/1987 |
| EP | 0 713 046 | A1 | 5/1996 |
| EP | 1442905 | A2 | 8/2004 |
| NL | 7 215 065 | A | 5/1974 |
| WO | 97/43528 | A1 | 11/1997 |

* cited by examiner

*Primary Examiner* — Forrest M Phillips
(74) *Attorney, Agent, or Firm* — McGlew and Tuttle, P.C.

(57) ABSTRACT

A silencer, particularly rear silencer, for an exhaust system of a combustion engine, particularly of a motor vehicle, has a housing in which an outlet chamber is located. An outlet pipe arrangement leads out of the housing which on the inlet side is fluidically connected to the outlet chamber. A particularly compact design can be realized if the outlet pipe arrangement is configured as pipe-in-pipe arrangement including at least one deflection pipe closed on one side and arranged in the housing and an outlet pipe led out of the housing.

20 Claims, 3 Drawing Sheets

SILENCER

CROSS REFERENCE TO RELATED APPLICATIONS

This application claims the benefit of priority under 35 U.S.C. §119 of German Patent Application DE 10 2010 008 403.4 filed Feb. 18, 2010, the entire contents of which are incorporated herein by reference.

FIELD OF THE INVENTION

The present invention relates to a silencer (also known as a muffler), particularly a rear silencer, for an exhaust system of a combustion engine, particularly of a motor vehicle.

BACKGROUND OF THE INVENTION

In an exhaust system a so-called rear silencer is usually located at an end section of the exhaust system on the outlet side. An outlet pipe leading out of the rear silencer usually forms a so-called tailpipe or is connected to such a tailpipe. The tailpipe has the mouth opening of the exhaust system that is open to the environment. Usually a silencer comprises a housing in which an outlet chamber is located and the outlet pipe is led out from said outlet chamber. For damping low-frequency noises it is usual to construct the outlet pipe of the rear silencer or the tailpipe comparatively long. Comparatively much space is required for this. Particularly in the case of smaller vehicles only little space is available. The use of very long outlet pipes or tailpipes is of increased importance especially with smaller combustion engines with for example three or four cylinders, particularly if the sound damping altogether is to be realized using less space and less weight.

SUMMARY OF THE INVENTION

The present invention deals with the problem of stating an improved embodiment for a silencer of the type mentioned at the outset, which is particularly characterized by a reduced construction volume.

According to the invention, a silencer is provided, particularly a rear silencer, for an exhaust system of a combustion engine, particularly of a motor vehicle. The silencer comprises a housing in which an outlet chamber is located. An outlet pipe arrangement leads out of the housing. The outlet pipe is fluidically connected to the outlet chamber on the inlet side. The outlet pipe arrangement is developed as pipe-in-pipe arrangement, comprising at least one deflection pipe closed on one side and arranged in the housing and an outlet pipe leading out of the housing.

The invention is based on the general idea of developing the outlet pipe not as a single pipe but as a pipe arrangement, namely as pipe-in-pipe arrangement. Such a pipe-in-pipe arrangement comprises at least one deflection pipe closed on one end and arranged in the housing of the silencer and an outlet pipe led out of the housing. Through the pipe-in-pipe arrangement, a comparatively long flow path can be realized with short length, which is carried out with the help of suitable deflections. The pipe-in-pipe arrangement can be constructed substantially shorter than a comparable pipe with identical flow length. Investigations have shown that the pipe-in-pipe arrangement achieves damping equivalent to that of a continuous pipe with respect to the low frequencies. At higher frequencies, an even better damping effect is achieved which is attributed to the cross-sectional jumps in the region of the flow deflections.

The proposed design thus allows a space-reduced realization of a silencer with long flow path in the "outlet pipe" or in the outlet pipe arrangement, with which the desired damping effect for low interference frequencies is additionally guaranteed.

According to an advantageous embodiment the pipe-in-pipe arrangement can create a flow path which from the outlet chamber to the outlet pipe comprises at least two 180° deflections. Because of this, a three-way layering for the exhaust flow is obtained, which ultimately results in a significant shortening of the outlet pipe arrangement compared with a single pipe.

With another embodiment it can be provided that the deflection pipe on its closed side comprises a bottom that is concavely curved towards the outlet pipe. Because of this, the through-flow resistance of the silencer can be reduced. In addition or alternatively, the housing or an outer pipe enveloping the deflection pipe can have a bottom that is concavely curved towards the deflection pipe on its side facing the open side of the deflection pipe. Because of this, the 180° deflection is favored, which reduces the through-flow resistance of the silencer.

A further optional measure for reducing the flow resistance is the provision of a flow deflection contour on an open side of the deflection pipe. With the help of such a flow deflection contour a resistance-reducing flow deflection can likewise be promoted. This can for example be a deflection collar deflecting the flow to the outside or a rounded-off end region likewise favoring the circulation.

According to another advantageous embodiment it can be provided to equip the outlet pipe on its inlet side, that is within the deflection pipe, with a perforation. Such a perforation can reduce the development of higher-frequency noises. In addition or alternatively the outlet pipe can be fastened to the deflection pipe on its inlet side. This produces a stabilization of the outlet pipe within the pipe-in-pipe arrangement. Fastening of the outlet pipe to the deflection pipe can more preferably be carried out also in the region of the perforation.

It is to be understood that the features mentioned above and still to be explained in the following cannot only be used in the respective combination stated, but also in other combinations or by themselves, without leaving the scope of the present invention.

Preferred exemplary embodiments of the invention are shown in the drawings and are explained in more detail in the following description, wherein same reference characters refer to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
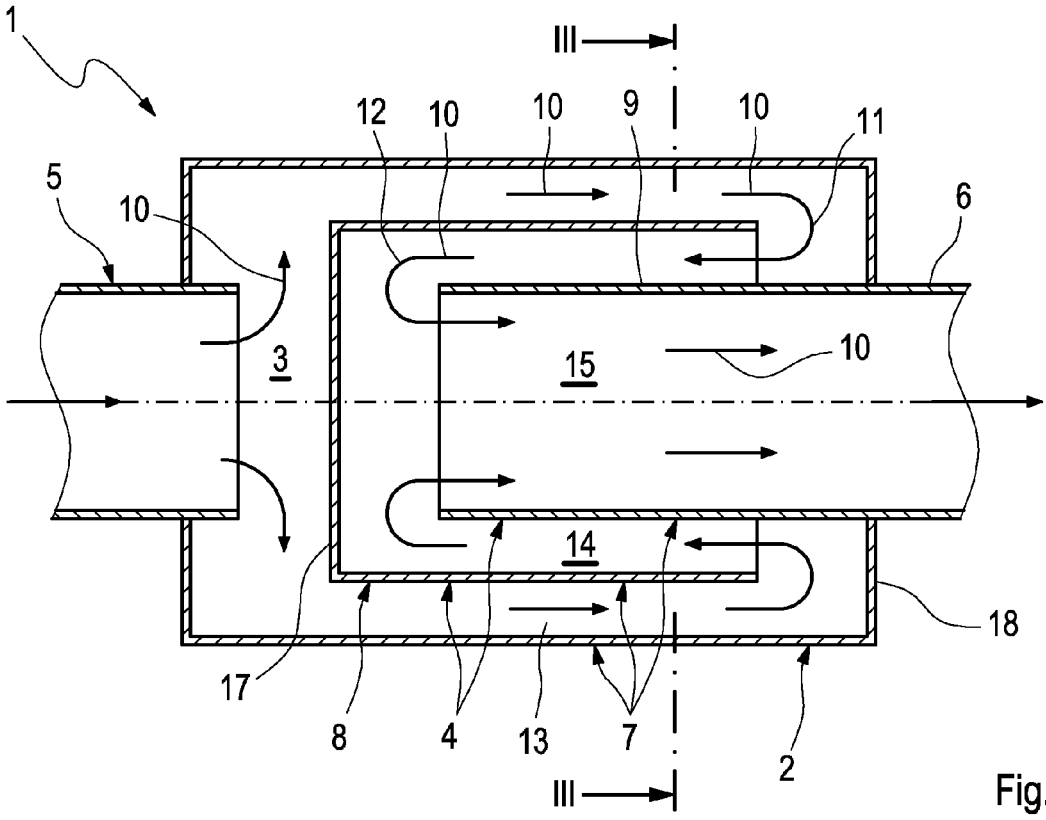
FIG. 1 is a highly simplified longitudinal sectional schematic view through a silencer of an embodiment according to the invention.
Figure 2:
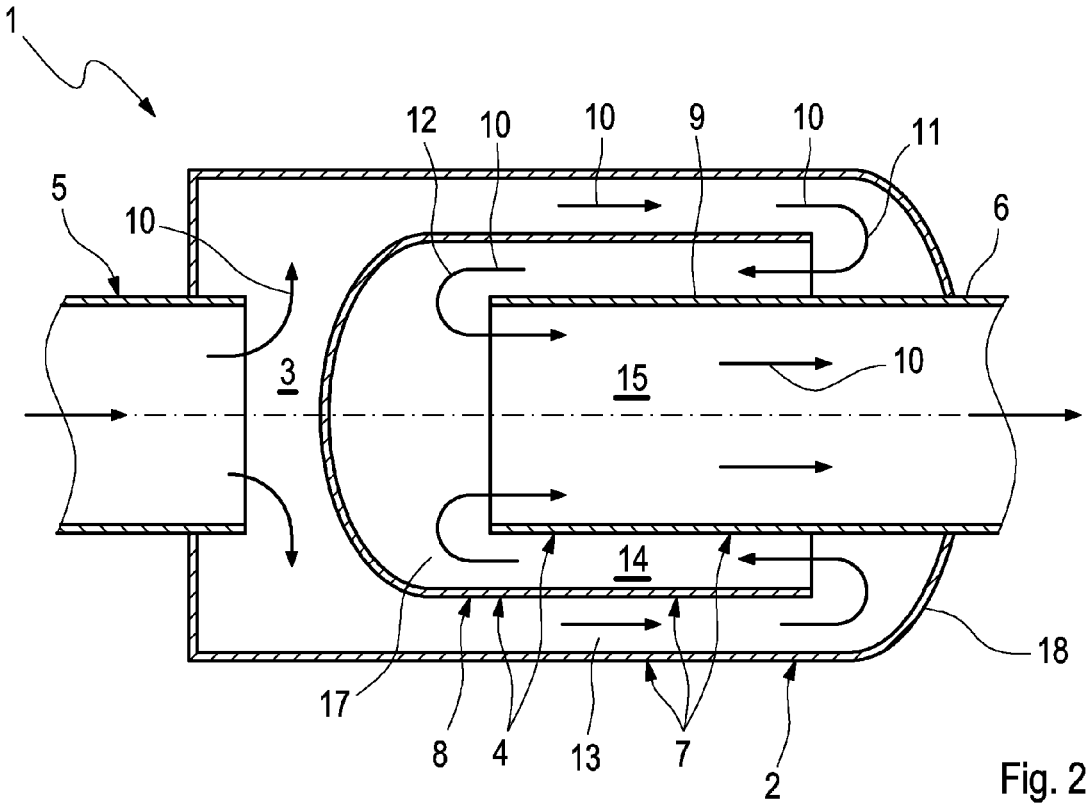
FIG. 2 is a highly simplified longitudinal sectional schematic view through a silencer of another embodiment according to the invention.

Referring to the drawings in particular, according to FIGS. 1 and 2 a silencer 1, which preferably is a rear silencer, comprises a housing 2 having an outlet chamber 3. An outlet pipe arrangement 4 is led out of the housing 2, namely in such a manner that the outlet pipe arrangement 4 on the inlet side is fluidically connected to the outlet chamber 3 located in the housing 2.

The silencer 1 in the installed state is incorporated in an exhaust system 5 which is only partially evident here and which belongs to a combustion engine that is not shown here, which can preferentially be arranged in a motor vehicle. Provided that the silencer 1 is preferably developed as rear silencer 1, it is located in an end region of the exhaust system 5 on the outlet end. In particular, the outlet pipe arrangement 4 led out of the housing 2 comprises a so-called tailpipe 6 of the exhaust system 5 or is connected to said tailpipe 6. The tailpipe 6 is characterized in that it comprises the mouth opening of the exhaust system 5 on the outlet side or of the respective line of the exhaust system 5. The rear silencer 1 is thus located on the tailpipe 6 or near the tailpipe 6.

With the silencer 1 introduced here the outlet pipe arrangement 4 is designed as pipe-in-pipe arrangement 7. The latter comprises at least one deflection pipe 8 and one outlet pipe 9. The deflection pipe 8 is arranged in the housing 2 and is closed on one side. The outlet pipe 9 is arranged in the deflection pipe 8 and led out of the housing 2. Provided that it is a rear silencer 1, the outlet pipe 9 can be connected to the tailpipe 6 or directly merge with the tailpipe 6 or itself form the tailpipe 6.

In the shown example the pipe-in-pipe arrangement 7 creates a flow path 10 indicated by arrows which leads from the outlet chamber 3 to the outlet pipe 9 or through the outlet pipe 9 out of the housing 2. Between outlet chamber 3 and outlet pipe 9 this flow path 10 contains at least two 180° deflections 11 and 12 respectively. The first 180° deflection 11 takes place in the housing 2 at the entry into the deflection pipe 8. The second 180° deflection 12 takes place in the deflection pipe 8 at the entry into the outlet pipe 9.

With the configuration presented here the pipe-in-pipe arrangement 7 comprises an outer channel 13 which is radially formed between the housing 2 and the deflection pipe 8. With another embodiment the outer channel 13 can also be formed between the deflection pipe 8 and an outer pipe which is not shown here, which is arranged within the housing 2 and envelopes the deflection pipe 8. In addition, the pipe-in-pipe arrangement 7 in this case comprises an inner channel 14 which is radially formed between the deflection pipe 8 and the outlet pipe 9. The first 180° deflection 11 connects the outer channel 13 to the inner channel 14. The second 180° deflection 12 connects the inner channel 14 to the interior 15 of the outlet pipe 9.

Practically, the housing 2, the deflection pipe 8 and the outlet pipe 9 and if applicable the outer pipe are arranged within one another axis-parallel to one another. According to FIG. 3, housing 2, deflection pipe 8 and outlet pipe 9 as well as the outer pipe if applicable can be arranged concentrically to one another. With the embodiment shown in FIG. 4 all involved pipes 8, 9 and the housing 2 are arranged eccentrically to one another. With the embodiment shown in FIG. 5 the outlet pipe 9 is arranged concentrically to the housing 2, while the deflection pipe 8 is arranged eccentrically to the housing 2 and to the outlet pipe 9.

Figure 5:
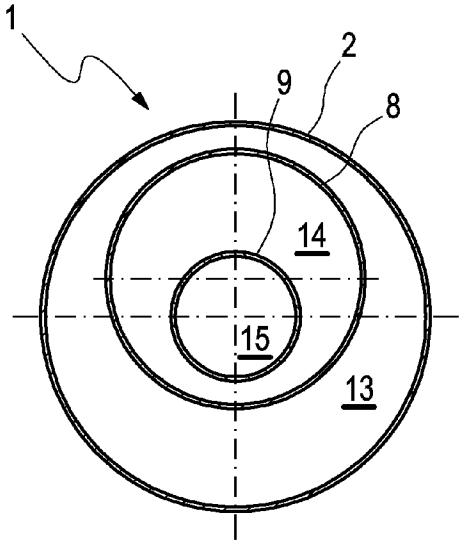
FIG. 5 is a cross sectional schematic view of the silencer from FIGS. 1 and 2 corresponding to the section lines III in FIG. 1, of another embodiment according to the invention.
Figure 4:
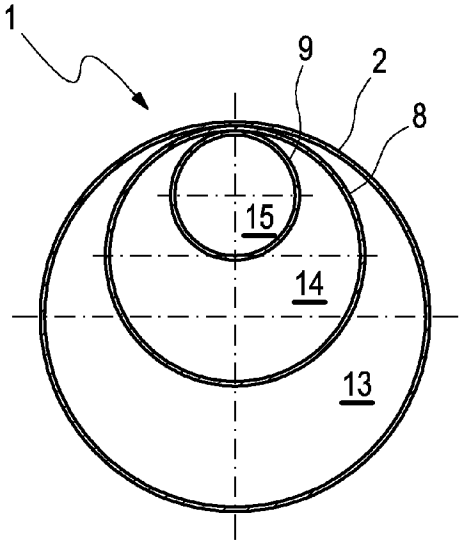
FIG. 4 is a cross sectional schematic view of the silencer from FIGS. 1 and 2 corresponding to the section lines III in FIG. 1, of another embodiment according to the invention.
Figure 3:
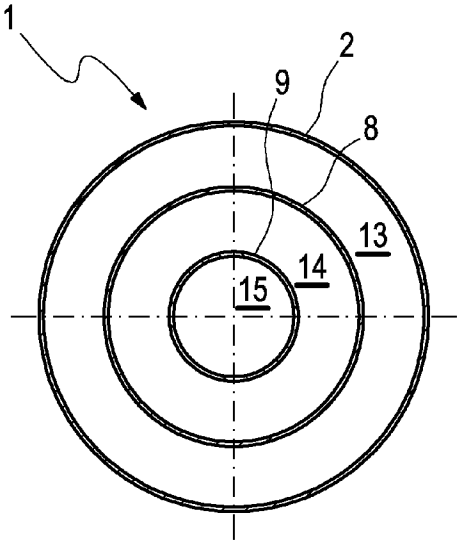
FIG. 3 is a cross sectional schematic view of the silencer from FIGS. 1 and 2 corresponding to the section lines III in FIG. 1, of an embodiment according to the invention.
Figure 6:
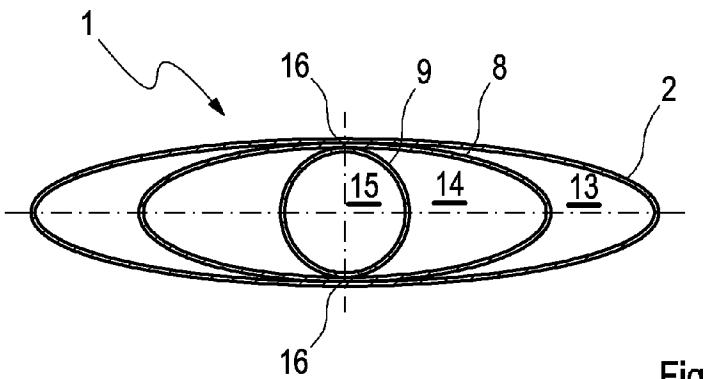
FIG. 6 is a cross sectional schematic view of the silencer from FIGS. 1 and 2 corresponding to the section lines III in FIG. 1, of another embodiment according to the invention.

While FIGS. 3 to 5 show embodiments with circular cross sections, another embodiment is shown in FIG. 6 wherein the deflection pipe 8 and the housing 2 show other round, particularly elliptical or oval cross sections. Selected here is an example which leads to an extremely flat design for the silencer 1. In particular, the deflection pipe 8 and the housing 2 in this case are flattened so far that on the outlet pipe 9 two contact points 16 located diametrically opposite each other are obtained, in which the deflection pipe 8 touches the outlet pipe 9 as well as the housing 2. In the region of these contact points 16 the pipes 8, 9 and the housing 2 can be fastened to one another.

To reduce the through-flow resistance of the silencer 1 different measures can be realized. For example it is possible to dimension the through-flow capable cross section of the outer channel 13 with respect to the through-flow capable cross section of the inner channel 14 so that the through-flow capable cross section of the outer channel 13 is smaller than the through-flow capable cross section of the inner channel 14. Likewise, the through-flow capable cross section of the outer channel 13 can be identical in size to the through-flow capable cross section of the inner channel 14. Because of this, an excessive pressure increase on overflowing from the outer channel 13 into the inner channel 14 is avoided. In addition or alternatively it can be provided that the through-flow capable cross section of the inner channel 14 is smaller than the through-flow capable cross section of the outlet pipe 9. Likewise, it can also be provided here to select the through-flow capable cross section of the inner channel 14 identical to the through-flow capable cross section of the outlet pipe 9. In general, the through-flow capable cross sections of the outer channel 13, of the inner channel 14 and of the outlet pipe 9 can be matched to one another with respect to a reduced through-flow resistance.

Optionally it can be provided according to FIG. 2 to provide the deflection pipe 8 on its closed side with a bottom 17 which is concavely curved towards the outlet pipe 9. Because of this, the second 180° deflection 12 can be supported or realized with a reduced flow resistance. In addition or alternatively to this, the housing 2 in the example of FIG. 2 on its side facing the open side of the deflection pipe 8 is equipped with a bottom 18 penetrated by the outlet pipe 9, which bottom is concavely curved towards the deflection pipe 8. Through this shaping of the bottom 18 the first 180° deflection 11 can be supported or realized with a reduced flow resistance.

Figure 7:
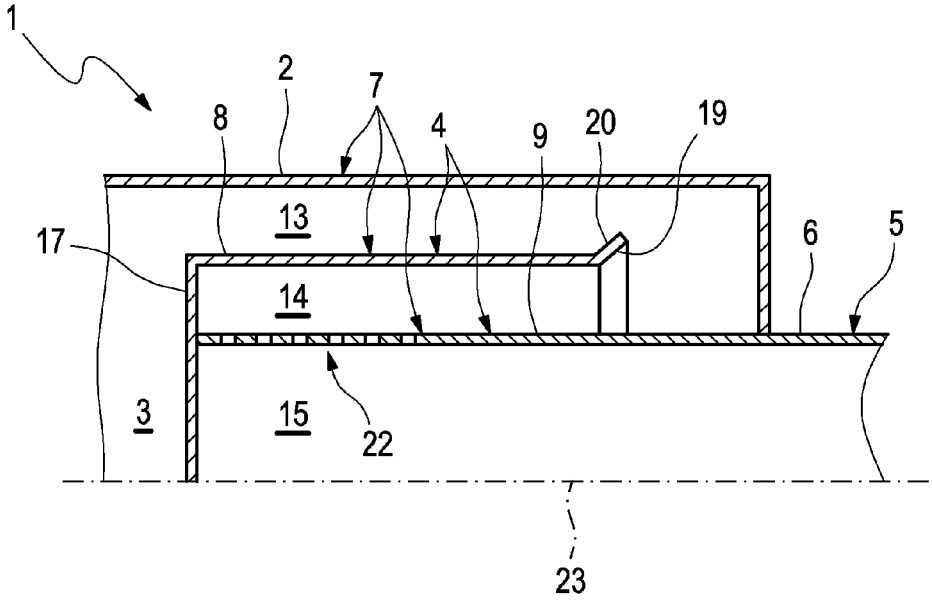
FIG. 7 is a highly simplified half longitudinal sectional schematic view of the silencer according to an additional embodiment.
Figure 8:
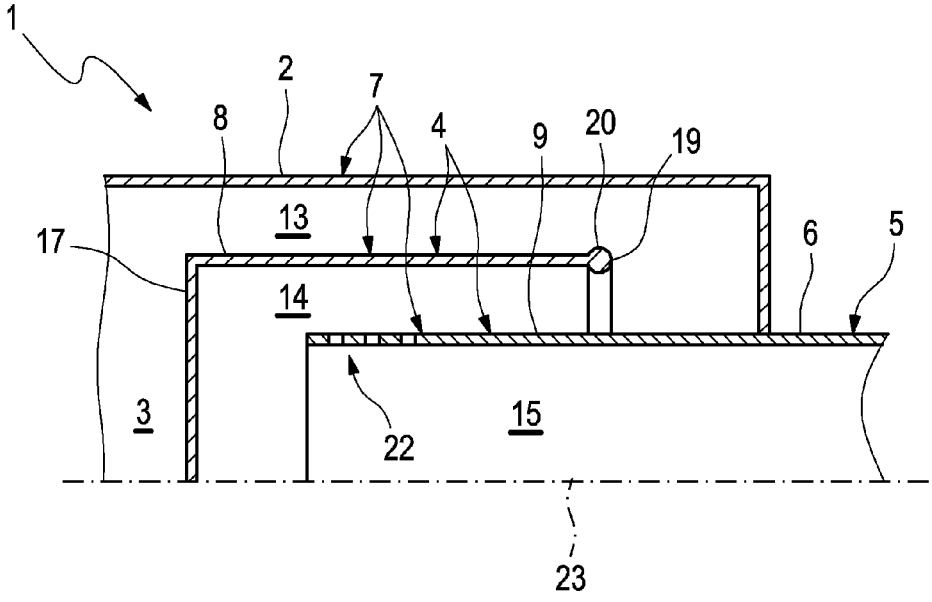
FIG. 8 is a highly simplified half longitudinal sectional schematic view of the silencer according to another additional embodiment.

According to FIGS. 7 and 8 the deflection pipe 8 can have a flow deflection contour 19 on its open side. This is also a measure to reduce the flow resistance. According to FIG. 7, the flow deflection contour 19 can for example be a deflection collar 20 deflecting the flow towards the outside. In contrast with this, the flow deflection contour 19 according to FIG. 8 can also be a rounded-off end region 21. Other configurations for the flow deflection contour 19 which are not shown here are likewise conceivable.

With the embodiments of FIGS. 7 and 8 the outlet pipe 9 is provided with a perforation 22 on its inlet side. Such a perforation 22 can impede a noise development upon inflow in the outlet pipe 9. With the embodiment shown in FIG. 7, the outlet pipe 9 protrudes into the deflection pipe 8 so far that it can be fastened to the deflection pipe 8 at its inlet side. In the example, the outlet pipe 9 is fastened to the deflection pipe 8 in the region of its perforation 22, specifically to its space 17. Because of this, the outlet pipe 9 is stabilized within the pipe-in-pipe arrangement 7. In contrast with this, FIG. 8 shows an embodiment wherein the outlet pipe 9 freely standing protrudes into the deflection pipe 8.

The representations of FIGS. 7 and 8 are half sections, wherein a dash-dotted line 23 represents a symmetry line with respect to which the respective representation can be completed mirror-symmetrically.

While specific embodiments of the invention have been shown and described in detail to illustrate the application of the principles of the invention, it will be understood that the invention may be embodied otherwise without departing from such principles.

What is claimed is:

1. A silencer for an exhaust system of a combustion engine, the silencer comprising:

a housing with an inlet and in which an outlet chamber is located;

an outlet pipe arrangement leading out of the housing, the outlet pipe arrangement being fluidically connected to the outlet chamber on an inlet side thereof, the outlet pipe arrangement being a pipe-in-pipe arrangement comprising at least one deflection pipe with a closed end on one side and arranged in the housing and an outlet pipe leading out of the housing, said closed end extending across a longitudinal direction of said outlet pipe, said deflection pipe being imperforate around said outlet pipe with axial walls parallel to said outlet pipe, an outer channel being defined between an outside of said deflection pipe and an inside of said housing, said first inlet of said housing being in communication with said outer channel.

2. The silencer according to claim 1, wherein the pipe-in-pipe arrangement creates a flow path from the outlet chamber to the outlet pipe, the flow path comprising at least two 180° deflections.

3. The silencer according to claim 1, wherein the pipe-in-pipe arrangement comprises an inner channel formed between the deflection pipe and the outlet pipe.

4. The silencer according to claim 3, wherein a through-flow capable cross section of the outer channel is smaller than or equal in size to a through-flow capable cross section of the inner channel.

5. The silencer according to claim 3, wherein a through-flow capable cross section of the inner channel is smaller than or identical in size to a through-flow capable cross section of the outlet pipe.

6. The silencer according to claim 3, wherein a through-flow capable cross sections of the outlet channel, a through-flow capable cross section of the inner channel and of a through-flow capable cross section of the outer channel are matched to one another with respect to a reduced through-flow resistance.

7. The silencer according to claim 1, wherein the housing or an outer pipe enveloping the deflection pipe, the deflection pipe and the outlet pipe are arranged within one another axis-parallel to one another.

8. The silencer according to claim 5, wherein the housing or an outer pipe enveloping the deflection pipe, the deflection pipe and the outlet pipe are arranged concentrically to one another.

9. The silencer according to claim 5, wherein at least two of the group comprising the housing or an outer pipe enveloping the deflection pipe, the deflection pipe and the outlet pipe are arranged eccentrically to one another.

10. The silencer according to claim 1, wherein the closed side of the deflection pipe comprises a bottom that is concavely curved towards the outlet pipe.

11. The silencer according to claim 1, wherein the housing or an outer pipe enveloping the deflection pipe on its side facing the open side of the deflection pipe comprises a bottom that is concavely curved towards the deflection pipe.

12. The silencer according to claim 1, wherein an open side of the deflection comprises a flow deflection contour.

13. The silencer according to claim 12, wherein the flow deflection contour is configured as one of a deflection collar deflecting flow to the outside and as a rounded-off end region.

14. The silencer according to claim 1, wherein the outlet pipe on has an inlet side comprising a perforation.

15. The silencer according to claim 1, wherein the outlet pipe has an inlet side axially fastened to the closed end of the deflection pipe, and wherein the outlet pipe is radially perforated in the area of said inlet side.

16. A silencer for an exhaust system of a combustion engine of a motor vehicle, the silencer comprising:

a housing defining an outlet chamber and an inlet opening;

an outlet pipe arrangement leading out of the housing, the outlet pipe having an inlet side fluidically connected to the outlet chamber, the outlet pipe arrangement comprising a deflection pipe disposed within the housing, the deflection pipe having a closed end and an open end with an deflection pipe axial extent between the closed end and an open end and an outlet pipe extending out of the housing, the outlet pipe having an outlet pipe axial extent with a portion of the outlet pipe axial extent positioned within a region of the deflection pipe axial extent between the closed end and the open end to define a pipe-in-pipe arrangement, the pipe-in-pipe arrangement defining an exhaust flow path from the inlet opening of the housing to the outlet pipe, the flow path comprising at least two 180° deflections of flow path direction, said deflection pipe being imperforate around said outlet pipe with axial walls parallel to said outlet pipe, an outer passage being defined between an outside of said deflection pipe and an inside of said housing, said inlet opening of said housing being in communication with said outer passage.

17. A silencer for an exhaust system of a combustion engine, the silencer comprising:

a housing having a first end and a second end, said housing defining a first opening at said first end, and a second opening at said second end;

an inside pipe extending from said second opening of said housing into an inside of said housing, said inside pipe defining an interior passage with an interior radial dimension, said interior passage being in communication with said second opening of said housing;

a deflection pipe arranged inside said housing, said deflection pipe having a closed end closer to said first end of said housing than to said second end, said deflection pipe having an open end closer to said second end of said housing than said first end, said inside pipe extending from said second end of said housing into said open end of said deflection pipe, said closed end of said deflection pipe extending across said interior radial dimension of said inside pipe, said deflection pipe being imperforate around said inside pipe with axial walls parallel to said inside pipe, an outer passage being defined between an outside of said deflection pipe and an inside of said housing, said first opening of said housing being in communication with said outer passage.

18. The silencer according to claim 17, wherein:

an outside of said inside pipe and an inside of said deflection pipe define a deflection passage, said deflection passage being in communication with said outer passage at said second end of said housing, said interior passage being in communication with said deflection passage at said closed end of said deflection pipe.

19. The silencer according to claim 17, wherein:

said first opening of said housing is in direct communication with said outer passage;

an outside of said inside pipe and an inside of said deflection pipe define a deflection passage, said deflection passage being in direct communication with said outer passage at said second end of said housing, said interior passage being in direct communication with said deflection passage at said closed end of said deflection pipe.

20. The silencer according to claim 17, wherein:

a flow path extends serially from said first opening of said housing to said outer passage, to said deflection passage, to said interior passage, and to said second opening of said housing.

* * * * *